US005269502A

United States Patent [19]

Joyce

[11] Patent Number: 5,269,502

[45] Date of Patent: Dec. 14, 1993

[54] CLAMPING HEAD ASSEMBLY

[75] Inventor: Walter A. J. Joyce, Chorleywood, United Kingdom

[73] Assignees: Magnolia Group PLC; W. & M. Joyce Engineers Ltd., both of England

[21] Appl. No.: 907,395

[22] Filed: Jul. 1, 1992

[30] Foreign Application Priority Data

Jul. 3, 1991 [GB] United Kingdom ..... 9114377

[51] Int. Cl.[5] ..... B25B 1/20

[52] U.S. Cl. ..... 269/42; 269/233

[58] Field of Search ..... 227/152; 369/42, 41, 369/254 R, 234, 233, 217, 138, 136, 137, 135

[56] References Cited

U.S. PATENT DOCUMENTS

| | | | |
|---|---|---|---|
| 1,206,399 | 11/1916 | Bartlett | 269/138 |
| 1,457,307 | 6/1923 | Kerns | 269/138 |
| 3,944,200 | 3/1976 | Huntley | 269/42 |
| 4,411,415 | 10/1983 | Denaro | 269/134 |
| 4,572,420 | 2/1986 | Pistorius | 227/152 |

*Primary Examiner*—Robert C. Watson

*Attorney, Agent, or Firm*—Basile and Hanlon

[57] ABSTRACT

A clamping head assembly for clamping frame members in an underpinning machine includes a pair of clamping members each of which has upper and lower elements spring biased apart. The lower element carries a friction pad and is connected by a pin and slot connection or a parallelogram linkage to the upper element. Downward pressure on the clamping members causes slight longitudinal movement of the friction pad tending to pinch together the frame members at a mitre joint where they are held, for example, for underpinning.

10 Claims, 3 Drawing Sheets

FIG 1
PRIOR ART
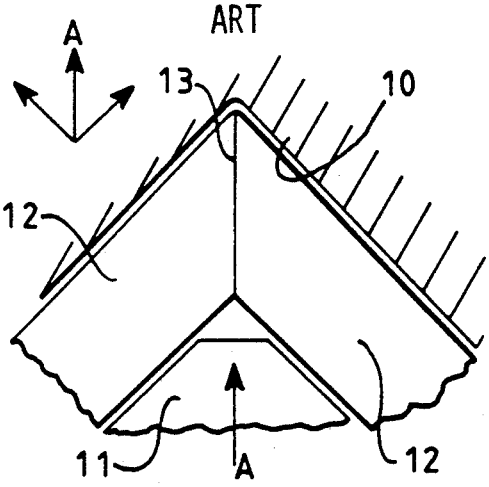
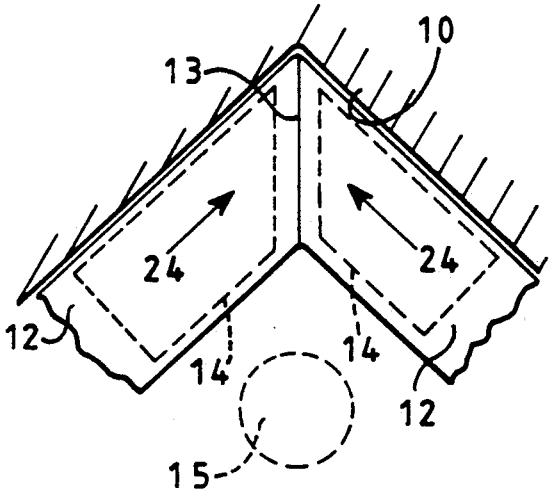
FIG 2
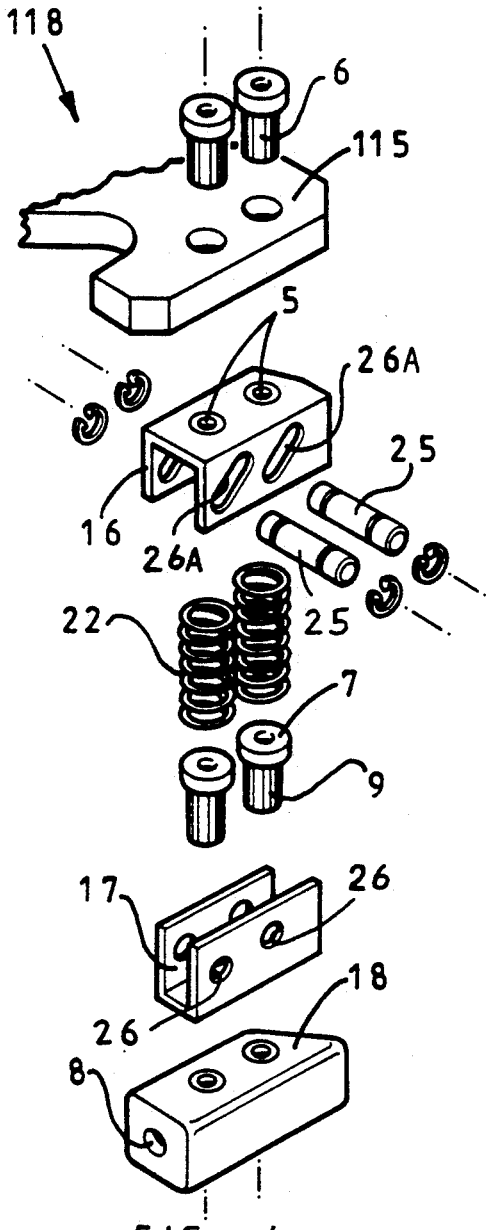
FIG 4

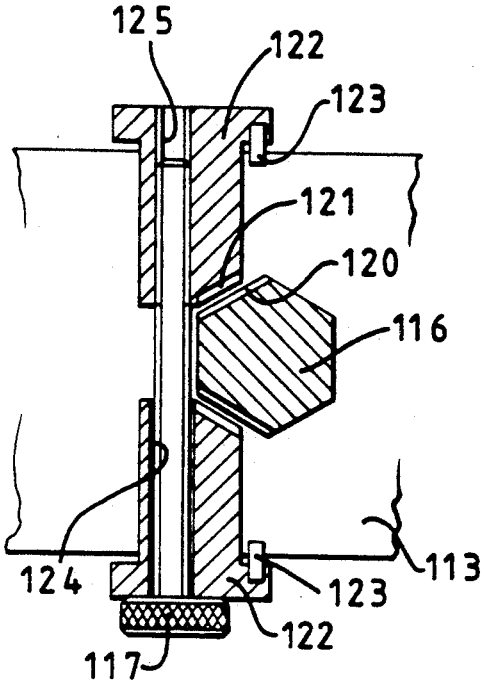
FIG 7
FIG 8
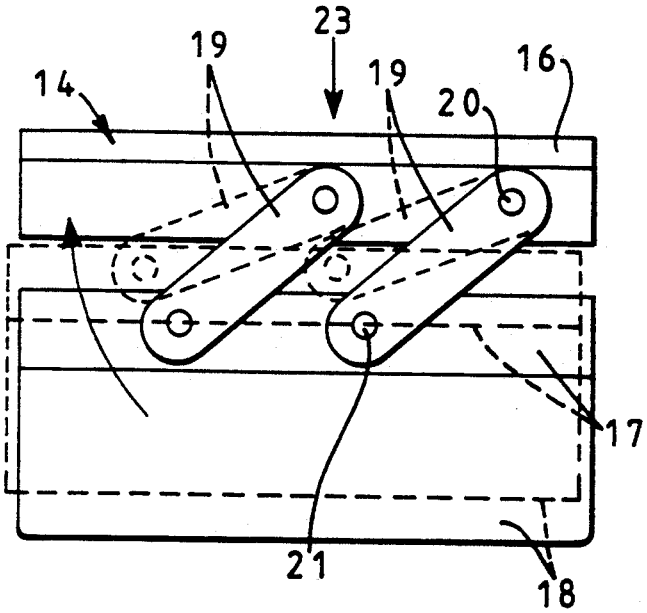
FIG 9
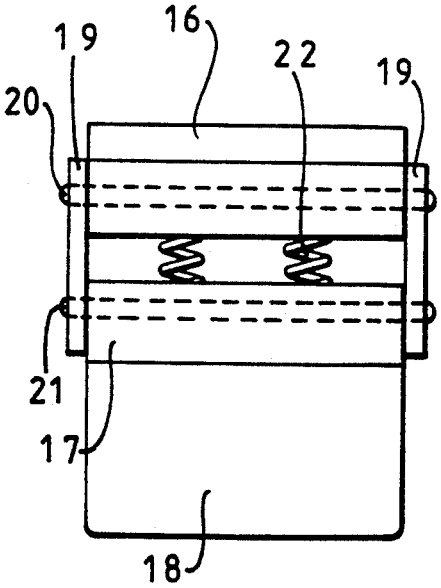

CLAMPING HEAD ASSEMBLY

BACKGROUND OF THE INVENTION

1. Field of the Invention:

This invention relates to a clamping head assembly for underpinning of joints between two mitred members. It was specially devised for the underpinning of picture frames but may have other uses.

2. Description of the Prior Art

Prior clamping head arrangements have required the exact positioning of a pair of mitred members in a right-angled locator to be done by hand, following which the members are clamped mechanically in position by the clamping head. In a first type of clamping head, this has been done by the application of downward pressure only. In a second type, a right-angled clamping member lying in the general plane of the mitred members is moved into a clamping position along the line of the mitre.

It is a difficult, skilled operation to cut the mitres exactly and to ensure exact positioning of the mitred members before clamping. When any inaccuracy occurs, the prior clamping heads do not correct this and they may accentuate misalignments or distortions, which are then preserved in the underpinned joint.

For example, in the first described type of prior clamping head, if the mitres are not cut exactly vertical, the downward pressure of the clamping head may open up the front face of the mitre. In a picture frame for example, this is the face which is visible in use. If the mitred ends are not correctly positioned or are released before clamping takes place, the second type of clamping head may force them apart, since the force exerted along the direction of the mitre has a component in the direction across the frame members, tending to open the joint.

With the second-mentioned prior type of clamping head, the working table of the machine is obstructed by the right-angled clamping member, making it difficult to manipulate the mitred members and slowing down the underpinning operation.

SUMMARY OF THE INVENTION

It is an object of the present invention to provide a new or improved clamping head assembly for underpinning of joints, which permits relatively quick and easy clamping and the achievement of a good standard of finish.

According to the invention there is provided a clamping head assembly for clamping a pair of members. The assembly comprises a pair of clamping means each comprising a resilient friction pad adapted to contact one of the members and provided on one of a pair of relatively movable elements which are resiliently biased apart. The elements are arranged to have a component of relative movement in a direction parallel to the one member when forced together against said bias.

The elements may be connected by a pin and slot coupling or by a parallelogram linkage for example.

BRIEF DESCRIPTION OF THE DRAWINGS

Embodiments of the invention will now be described in more detail by way example only with reference to the accompanying drawings in which:

FIG. 1 is a diagrammatic plan view of a prior art clamping head,

FIG. 2 is a diagrammatic plan view similar to that of FIG. 1, but s the operation of a clamping head assembly embodying the present invention, FIG. 4 is an enlarged detail exploded view of part the clamping head shown in FIG. 3, FIG. 7 is an enlarged detail sectional view of a clamp, FIG. 8 is a front elevational view of a second embodiment of the means, and FIG. 9 is an end elevational view of the clamping means of FIG. 8.

DESCRIPTION OF THE PREFERRED EMBODIMENTS

Figure 3:
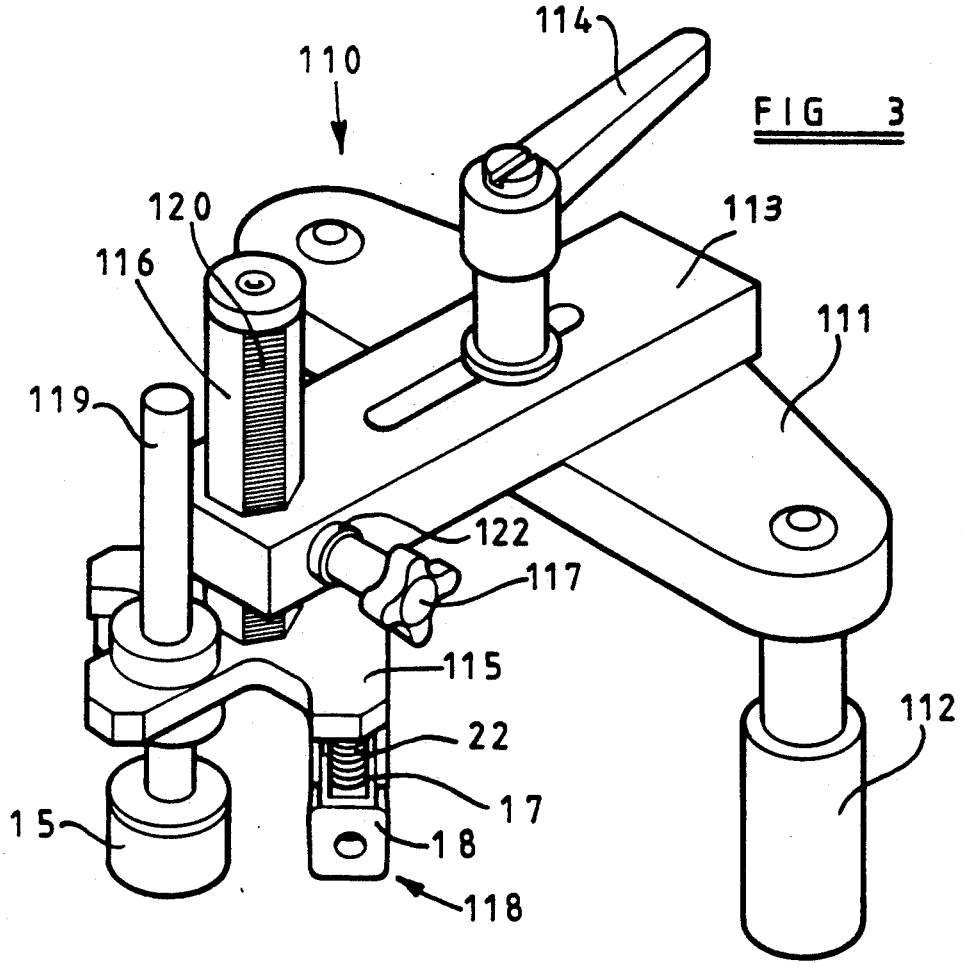
FIG. 3 is an isometric view of a clamping head of the present invention.

Referring to FIG. 1 of the drawings (prior art), a conventional clamping head assembly comprises a right-angled clamping location 10 and a right-angled clamping member 11 which is moved towards the right-angled corner of the clamping location 10. A pair of frame members 12 are inserted by hand in the right-angled location 10 and the clamping member 11 is then moved along the line of abutment of the frame members 12, which is a mitre joint 13. If the mitre joint 13 is not correctly aligned, the force exerted in the direction of the arrow A by the clamping member 11 will tend to separate the frame members 12 at the mitre joint 13 if they are not manually held firm. The force diagram at the left-hand side of FIG. 1 illustrates how the force exerted by the clamping member 11 can be resolved into components both along and across each frame member 12.

The frame members 12 can only be manipulated while the clamping member 11 is withdrawn, so that the operator needs to wait until the machine has cycled fully before removing and inserting the frame members 12. The speed of operation is therefore limited. Even when fully withdrawn, the clamping member 11 forms a partial obstruction of the working table of the machine, and this may hinder attempts to repair or service the underpinning head itself.

In FIG. 2 of the drawings, a clamping head assembly of the present invention is illustrated in use. The same form of V-shaped or right-angled clamping location 10 is provided for the mitred frame members 12 which are again inserted by hand. However, a pair of clamping means 14 indicated in dotted outline are used to exert forces along the line of arrows 24, aligned with the frame members 12 so as to close up the mitre joint 13. The clamping means 14, to be described in more detail hereafter, have resilient friction pad surfaces acting on the exposed face of the frame members 12, so that if the mitre joint 13 is not exactly vertically cut, there is a tendency for the faces at least of the mitred members 12 to be brought together at the mitre joint 13, giving a very good visual appearance in the finished frame.

Where very broad frame members 12 are used, an additional pressure pad 15 may be used to support the inner edges of the mitre 13.

Referring now to FIGS. 3–7 of the drawings, a first clamping means embodying the invention is shown. FIG. 3 shows a clamping assembly generally indicated at 110. The clamping head assembly 110 comprises a bridge 111 supported by a pair of pillars, only one of which is shown by reference number 112. The bridge 111 is supported over the bed of the machine and carries a projecting arm 113 which is adjustable for position relative to the bridge 111 by means of a manual clamp 114. It will be appreciated that a generally known type of right-angled clamping location is provided below the top clamping assembly to receive a pair of framing members to be secured together by underpinning.

The clamping assembly 110 further comprises a generally three armed mounting plate 115 which is vertically adjustable for height on the arm 113 by means of a hexagonal bar 116 and a hand clamp 117 to be described later in more detail with reference to FIG. 7 of the drawings. The mounting plate 115 carries a pair of clamping means 118 outlined in FIG. 3 and shown in an exploded view in FIG. 4. Additionally, the mounting plate 115 carries a pressure pad 15 of the type previously referred to which enables broad framing members to be readily handled. The pressure pad 15 is a simple circular pad of resilient material and is mounted for vertical adjustment on a bar 119 mounted on the mounting plate 115.

Turning in more detail to the construction of the clamping means 118 shown in FIG. 4, the clamping means 118 comprises interfitting upper and lower channels, the upper channel being indicated at 116 and facing downwardly and the lower channel being indicated at 17 and facing upwardly. A pair of helical coil springs 22 are located between the channels 16 and 17 so as to resiliently bias the channels 16 and 17 apart. The channels 16 and 17 are connected by transverse pins 25 passing through apertures and slots 26, 26A in the lower and upper channel elements 17 and 16. Thus, the channels 16 and 17 are connected together by the pins 25 but can move towards and away from each other, such movement being accompanied by a longitudinal movement of one channel relative to the other.

The lower channel element 17 has a resilient friction pad 18 of thick hard rubber (80 Shore) or urethane secured to it by means of a pair of headed screws 9 which pass through the base of the channel 17 and engage in recesses in a pin 8 provided longitudinally up the center of the friction pad 18. The heads 7 of the screws 9 serve to locate the lower ends of the springs 22. The upper ends of the springs 22 are located by a pair of screws 6 which pass through the mounting plate 115 and engage in threaded holes 5 in the upper channel element 16, securing the clamping means 118 to the mounting plate 115.

Figure 5:
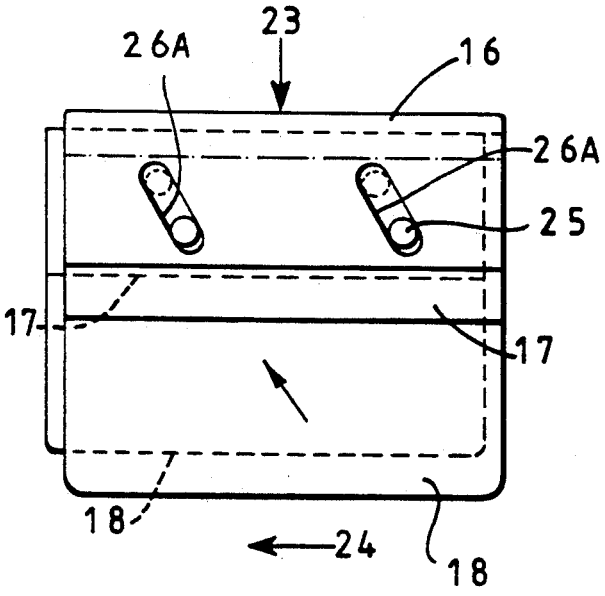
FIG. 5 is a front elevational view of a first embodiment of a clamping means.
Figure 6:
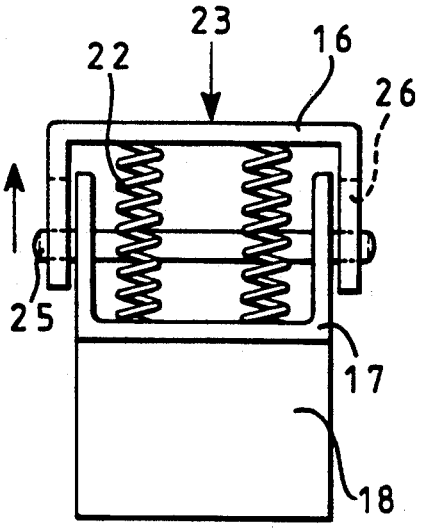
FIG. 6 is an end elevational view of the clamping means of FIG. 5.

In use, the mounting plate 115 is forced downwardly by powered contraction of the pillars 112 carrying the bridge 111, for example by pneumatic means. The upper channel element 16 applies a vertical downward force in the direction of the arrow 23 as seen in FIGS. 5 and 6. When the resilient friction pad 18 contacts the frame member 12 to be underpinned, the downward force acting in the direction of the arrow 23 overcomes the bias of the springs 22 and moves the upper and lower channel elements 16 and 17 together. However due to the presence of the pin and slot connections 25, 26, 26A, this does not cause simply a vertical movement of the friction pad 18. As force is exerted downwardly on the arrow 23, the lower channel element 17 is constrained by the pins 25 moving in the slots 26, 26A to provide a component of movement along the arrow 24, that is, along the general axis of the friction pad 18 and the underlying frame member 12.

Since a similar action takes place in the other of the clamping means, it will be appreciated that each of the two frame members 12 is firstly contacted by a respective friction pad 18 and is then urged in a direction towards the mitre joint 13 as illustrated in FIG. 2 of the drawings. Furthermore, because the contact with the friction pad 18 is at the upper face of the framing member 12, any slight inaccuracy in the cutting of the mitre 13 is compensated for because the forward face tends to be closed up by the longitudinal movement along the arrows 24.

In an alternative form of clamping means embodying the invention, shown in FIGS. 8 and 9 of the drawings, a clamping means 14 comprises an upper element 16 and a lower element 17, each in the form of a block or channel. The friction pad 18 is secured to the lower element 17 as before. Similarly, the upper and lower elements 16 and 17 are resiliently biased apart by spring means 22.

However, the elements 16 and 17 are secured together by a parallelogram linkage comprising two pairs of links 19, pivotally secured by pins 20, 21 to the upper element 16 and the lower element 17. In use, the upper element 16 is mounted as previously described on the mounting plate 115. Movement of the mounting plate 115 applies a vertical downward force in the direction of the arrow 23. When the resilient friction pad 18 contacts the frame member 12, the downward force in the direction of the arrow 23 overcomes the bias of the springs 22 and moves the elements 16 and 17 together.

Owing to the presence of the parallelogram links 19, the movement of the upper and lower elements 16 and 17 has a component along the direction of the frame member 12 indicated by the arrow 24 in FIGS. 2 and 8. The initial and final positions of the lower element 17 are illustrated in full and dotted lines, respectively, in FIG. 8. When the lower element 17 abuts the upper element 16, no further lateral movement is possible. At this point, any further downward force exerted in the direction of the arrow 23 tends to apply downward clamping pressure to the frame member 12. However, by this time, both the frame members 12 are securely abutted at a clean mitre joint 13 due to the force exerted along the arrows 24.

In order to ensure that the correct movement takes place, the parallelogram links 19 of FIGS. 8 and 9 have an angle of between 35° and 40° to the horizontal; while the slots 26 of the embodiment shown in FIGS. 3–6 have an angle of 5 between 30° and 35° to the vertical.

Referring now to FIG. 7 of the drawings, it is essential that the movement of the bridge 111 is transferred to the clamping means without the adjustable clamp 117 slipping. In order to prevent this, the hexagonal bar 116 which is shown in more detail in FIG. 7, is provided with serrations 120 on two faces which are neither opposite nor adjacent each other. The serrations 120 are slightly out of phase with each other.

At each face of the bar 116, a serrated portion 121 is provided on a headed clamping member 122, two of which are introduced from opposite sides of the bar 116 and located against rotation by location pins 123 in a suitable opening in the arm 113 of the clamping head assembly. A clamping screw passes through a clearance hole 124 in one of the headed members 122 and is secured in a tapped hole 125 of the other headed member 122. The clamping screw has the manually engageable knob 117 illustrated in FIG. 3 of the drawings mounted thereon.

In use, a spring means (not shown) is used to spring the headed clamping members 122 apart when the clamping screw 117 is released. When it is tightened, the serrated portions 121 engage the serrated faces 120 at the desired clamping position to ensure that the clamping head does not slip. The reason why the two sets of serrations 120 are out of phase with each other is to ensure that at least one of the headed clamping members 122 makes full engagement with the serrations 120.

In use, the clamping head assembly enables the positioning of the frame members to be reliably achieved with minimum skill. It also replaces the conventional reliance on the use of V-shaped underpinning nails or wedges to tend to pull together the frame mitre joints. This has resulted in elaborate design features being needed in the small V-nails or wedges to ensure that they flare outwardly as they are inserted by an underpinning machine and hence apply a restoring force to the joint once the underpinning operation has been carried out. By means of the clamping head assemblies described, it is no longer necessary to ensure that the wedges or V-nails exert this resilient restoring force on the frame members which should be correctly positioned by the clamping head assembly prior to insertion of the V-nails or wedges by the underpinner.

The clamping head assembly may be provided as part of an underpinning machine or may be adapted for fitment to an existing underpinning machine.

I claim:

1. A clamping head assembly for clamping down a pair of members to be joined at a joint, each member having an upper surface, the clamping head assembly comprising:

a pair of clamping means each comprising a resilient friction pad adapted to contact the upper surface of one of the members and provided on one of a pair of relatively moveable elements resiliently biased apart, the moveable elements including an upper element and a lower element, the friction pad being provided on the lower element, the movable elements being arranged to have a component of relative movement in a direction parallel to the one member towards the position of the intended joint when the upper element is forced downwardly towards the lower element against the bias, whereby the members are successively pushed along their respective lengths towards the position of the intended joint and clamped down by the clamping means.

2. The clamping head assembly according to claim 1 wherein the movable elements are connected by a pin and slot connection.

3. The clamping head assembly according to claim 1 wherein the movable elements are connected together by a parallelogram linkage.

4. The clamping head assembly according to claim 1 wherein the pair of clamping means are secured to a mounting plate adjustable for height.

5. The clamping head assembly according to claim 4 wherein the mounting plate is mounted on an upright bar by a clamp.

6. The clamping head assembly according to claim 5 wherein the upright bar is serrated and the clamp includes a pair of clamping elements associated with the mounting plate and having serrations adapted to engage the serrations of the upright bar and forced together to thus engage the upright bar by manually operated clamping screw means.

7. The clamping head assembly according to claim 4 wherein a pressure pad is provided on the mounting plate spaced from the friction pads.

8. The clamping head assembly according to claim 4 wherein the mounting plate is mounted on a member having powered raising and lowering drive means.

9. The clamping head assembly according to claim 8 wherein the mounting plate is adjustably mounted.

10. An underpinning machine including a clamping head assembly of claim 1.

* * * * *